US005597650A

United States Patent [19]

Mallonee

[11] Patent Number: 5,597,650

[45] Date of Patent: Jan. 28, 1997

[54] CONJUGATE CARPET FACE YARN

[76] Inventor: William C. Mallonee, P.O. Box 2318, Dalton, Ga. 30722

[21] Appl. No.: 339,336

[22] Filed: Nov. 14, 1994

[51] Int. Cl.[6] ..... D02G 3/00

[52] U.S. Cl. ..... 428/370; 428/373; 428/374; 428/397; 428/85; 428/97; 525/184

[58] Field of Search ..... 428/85, 97, 373, 428/374, 397, 370; 325/184

[56] References Cited

U.S. PATENT DOCUMENTS

| | | | |
|---|---|---|---|
| 3,047,383 | 7/1962 | Slayter | 75/201 |
| 3,099,067 | 7/1963 | Merriam et al. | 28/82 |
| 3,220,173 | 11/1965 | Pitzl | 428/397 |
| 3,331,888 | 7/1967 | Cantatore | 525/184 |
| 3,359,344 | 12/1967 | Fukushima | 525/184 |
| 3,373,222 | 3/1968 | Armstrong | 260/857 |
| 3,454,512 | 7/1969 | Ahmed | 525/184 |
| 3,549,734 | 12/1970 | Yasuda et al. | 525/184 |
| 3,653,803 | 4/1972 | Hamner | 8/31 |
| 4,174,358 | 11/1979 | Epstein | 525/183 |
| 4,207,404 | 6/1980 | Coran et al. | 525/184 |
| 4,338,413 | 7/1982 | Coran et al. | 525/179 |
| 4,346,194 | 8/1982 | Roura | 525/66 |
| 4,410,661 | 10/1983 | Epstein | 525/66 |
| 4,478,978 | 10/1984 | Roura | 525/66 |
| 4,492,731 | 1/1985 | Bunkar et al. | 428/397 |
| 4,518,744 | 5/1985 | Brody | 525/184 |
| 4,595,730 | 6/1986 | Blondel et al. | 525/178 |
| 4,663,221 | 5/1987 | Mukimura et al. | 428/397 |
| 4,757,112 | 7/1988 | Phadke | 525/66 |
| 4,780,505 | 10/1988 | Mashita et al. | 525/66 |
| 4,782,114 | 11/1988 | Perron et al. | 525/66 |
| 4,806,299 | 2/1989 | Burns | 525/184 |
| 5,464,676 | 11/1995 | Hoyt et al. | 428/397 |
| 5,464,687 | 11/1995 | Sheth | 428/286 |
| 5,468,259 | 11/1995 | Sheth et al. | 55/179 |

FOREIGN PATENT DOCUMENTS

| | | | |
|---|---|---|---|
| 0235876 | 9/1987 | European Pat. Off. | C08L 23/02 |
| 0286734 | 10/1988 | European Pat. Off. | C08F 255/02 |
| 1403797 | 8/1975 | United Kingdom | C08L 77/00 |

*Primary Examiner*—Newton Edwards
*Attorney, Agent, or Firm*—Luedeka, Neely & Graham, P.C.

[57] ABSTRACT

The specification discloses a conjugate carpet face,yarn comprising trilobal or delta cross-section polyolefin filaments and a plurality of generally co-linear smaller polyamide fibrils embedded within the polyolefin filaments. This yarn has the stain resistant properties of polyolefin based yarns and the resiliency of polyamide based yarns.

12 Claims, 1 Drawing Sheet

CONJUGATE CARPET FACE YARN

FIELD OF THE INVENTION

The invention relates to a carpet face yarn having the stain resistant properties of polyolefin based yarns and the resiliency of polyamide based yarns.

BACKGROUND

Carpets for home and industrial use are typically made from synthetic or natural fibers such as nylon, polyester, polyolefins, acrylics, rayon, cellulose acetate, cotton and wool. Of the foregoing, synthetic carpets tend to be more commercially acceptable and can be used for a wider variety of applications.

Of the synthetic fibers, nylon is principally the polymer of choice for carpets. However, nylon is not without its drawbacks. Notably, nylon carpeting is susceptible to developing static electric charges and thus must be treated to reduce the build-up of static charges. Another disadvantage of nylon carpeting is that it will readily stain. Accordingly, nylon carpets are usually treated to reduce their staining tendencies. These treatments do not, however, prevent all staining, nor do they last for the life of the carpet.

On the other hand, carpets made from polyolefins, such as polypropylene, are very resistant to staining and are naturally antistatic. However, polypropylene is a more rigid and less resilient fiber and will not generally maintain its appearance or shape under prolonged or heavy use, or after repeated deformations.

An object of the invention therefor is to provide an improved carpet face filament.

Another object of the invention is to provide a carpet face filament having the resiliency of polyamide and the stain resistance of polyolefin.

Still another object of the invention is provide a method for forming a carpet face filament which exhibits inherent antistatic properties.

SUMMARY OF THE INVENTION

With regard to the above and other objects, the invention provides a conjugate carpet face yarn comprising trilobal or delta cross-section polyolefin filaments, preferably polypropylene, having a denier in the range of from about 1350 to about 1550 per 84 filaments and a plurality of generally co-linear substantially smaller polyamide fibrils,,preferably of nylon 6 embedded within the polyolefin filaments wherein the polyamide fibrils comprise from about 5 to about 40 wt. % of the total filament.

It has been found that the small polyamide fibrils which are preferably nylon 6, arranged in a polyolefin matrix in a principally polyolefin filament, provide in a polyolefin-type carpet yarn what amounts to nylon-type properties in terms of resiliency but without the draw backs of nylon. That is, the yarn exhibits the good anti-staining properties of polyolefins and their favorable flame retardancy and anti-static properties, but does not matt like polyolefin fibers. The yarn is also less costly to produce than nylon, since polypropylene is about 60% cheaper per pound in the current market than nylon.

In another preferred embodiment, the invention provides a method for making fiber for a carpet face yarn having the stain resistance of a polyolefin face yarn and the resiliency of a polyamide face yarn. The method comprises blending from about 5 to about 40 wt. % polyamide pellets with from about 60 to about 95 wt. % polyolefin pellets. The blend is then fed to a hot melt extruder to melt the mixture. Once melted, the molten mixture is forced at a shear rate within the range of from about 1000 to about 5000 reciprocal seconds through a spinneret containing a plurality of trilobal or delta capillary openings. The conjugate filaments thus formed contain polyamide fibrils formed in-situ in a trilobal or delta cross-section polyolefin matrix. Furthermore, the conjugate filaments have a denier ranging from about 1350 to about 1550 per 84 filaments.

DETAILED DESCRIPTION OF THE INVENTION

An important feature of the carpet face yarn of the invention is that it has the resiliency and flame retardance of polyamide yarns such as nylon 6 and nylon 66, yet has the stain resistance of polyolefin yarns such as polypropylene. Furthermore, the trilobal carpet face yarn of the invention is resistant to the formation of a static electric charge common to polyamide carpet yarns.

The polyolefins which may be used to form the carpet yarn of the invention includes polyethylene, polypropylene, poly(1-butene), poly(3-methyl-1-butene), poly(4-methyl-1-pentene), and the like as well as combinations or mixtures of two or more of the foregoing. Of the foregoing polyolefins, polypropylene is particularly preferred. One suitable source of polypropylene is the polypropylene available from Shell Chemical Company under the trade name designation 5A72.

The polyamide polymers used with the invention include the condensation product of a dibasic acid and a diamine such as adipic acid and hexamethylene diamine (nylon 66), and the addition reaction products of monomers containing both an acid and an amine group in the molecule, such as the polymerization product of e-caprolactam to form polycaproamide (nylon 6). Higher analogs of nylon 6 and 66 may also be used. Of the foregoing, nylon 6 is the most preferred polyamide for use in forming the carpet face yarn of the invention. One suitable source of nylon polymer is the nylon 6 polymer available from BASF Corporation under the trade name designation Type 403.

It is preferred that the polymeric mixture used to form the carpet face yarn contain from about 60 to about 95 wt. %, preferably from about 75 to about 85 wt. % polyolefin, and from about 5 to about 40 wt. %, preferably from about 10 to about 20 wt. % polyamide.

The polyolefin and polyamide polymers are preferably dry blended prior to feeding the mixture to the extruder. In the alternative, the polymers may be fed directly to the extruder in any order provided there is sufficient residence time in the extruder to assure thorough mixing of the two polymers. It will be recognized that a preformed mixture of polyolefin and polyamine may also be fed to the extruder.

Figure 1:
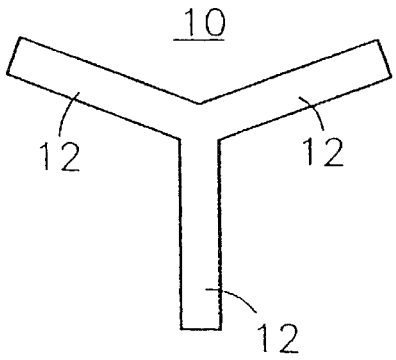
FIG. 1 is an illustration, not to scale, of a preferred spinneret orifice configuration for producing the carpet filaments of the invention.
Figure 2:
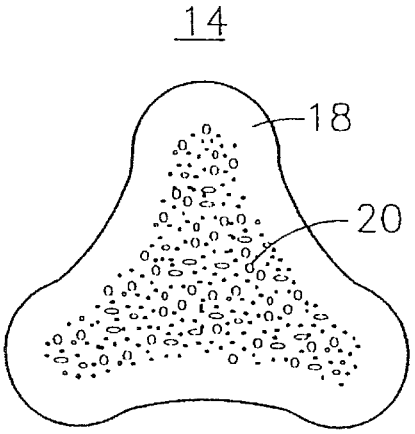
FIGS. 2 and 3 are cross-sectional illustrations, not to scale of the trilobal or delta conjugate filaments of the invention.
Figure 3:
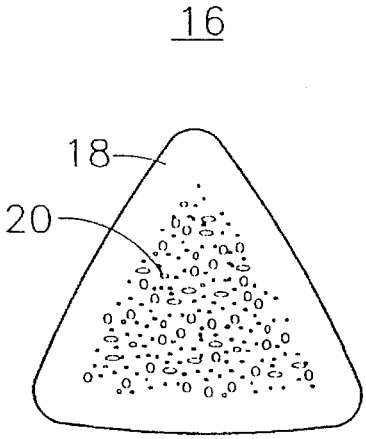

Once formed, the mixture of polyolefin and polyamide is melted and extruded using typical nylon 6 processing temperatures and procedures. Accordingly, the molten mixture is forced at a temperature within the range of 240° to about 270° C. through a spinneret containing a plurality of trilobal or delta capillary openings. FIG. 1 illustrates a capillary opening 10 for use in forming the filaments of the present invention in a trilobal configuration. The capillary opening 10 has legs 12 of equal length so that the melted mixture flows through the capillary opening 10 in legs 12 thereby increasing the shear rate on the molten mixture and causing the filament to set in a trilobal cross-sectional configuration 14 as illustrated in FIG. 2 or a delta cross-sectional configuration 16 as illustrated in FIG. 3. In FIGS. 2 and 3, the polyolefin 18 forms the bulk of the filament with fibrils 20 of polyamide dispersed within the filament, generally toward the center portions of the filament.

The shear rate of the molten mixture during extrusion is an important factor in practicing the present invention for optimal results. Shear rates in the range of from about 1000 to about 5000 reciprocal seconds are preferred. Particularly preferred is a shear rate within the range of from about 2000 to about 3000 reciprocal seconds, with a shear rate of about 2500 reciprocal seconds being most preferred. By selecting a plurality of capillary openings having a trilobal arrangement, the desired shear rate for extrusion of the mixture may be obtained.

After spinning, the conjugate filament thus formed is drawn one or more times, preferably about 3 times and then texturized with either a hot air jet or a steam jet. Unlike other polymeric materials, spinning, drawing and texturizing of the conjugate filaments in discrete batch operations is not required. Accordingly, the conjugate filaments of the invention may be spun, drawn and texturized essentially continuously without the need for a curing or a waiting period after each step. In the alternative, any two of spinning, drawing and texturizing may be done essentially continuously with a curing or waiting period after the batch step and before the continuous steps.

For purposes of obtaining colored carpet face yarns, the polymers which are combined to make the yarns of the invention may each contain pigments or chemical dyes, or the finished yarn may be dyed. Useful inorganic pigments include cadmium mercury, cadmium mercury orange, cadmium sulfide yellow, cadmiumsulfoselenide, titanium dioxide, titanium yellow, titanium green, titanium blue, cobalt aluminate, manganese blue, manganese violet, ultramarine red, ultramarine blue, ultramarine violet, chrome yellow, and the like. Organic pigments include permanent red 2B, perylene red, quinacridone red, diazo orange, diazo yellow, isoindolinone, hansa yellow, phthalocyanine green, phthalocyanine blue, quinacridone violet, doxazine violet, and the like. Chemical dyes include the mono- and disulfonated acid dyes, as well as anthraquinone, triphenylmethane, pyrazolone, azine, nitro and quinoline dyes. When used, the pigment dyes may be predispersed in the polyolefin masterbatch before the polyolefin and polyamide are extruded.

Since pure polyolefin filaments cannot generally be dyed with chemical acid or basic dyes, pigments dyes are typically used to give the polyolefin its color in a process known as "solution dyeing". Solution dyeing results in a permanent color that is highly resistant to staining or fading due to uv light. In contrast to pure polyolefin filaments, the conjugate filaments of the invention may be dyed with chemical acid or basic dyes in addition to the pigment dyes, and the dyed conjugate filaments of the invention typically have stain resistant properties similar to pure polyolefin filaments.

A particular advantage of the conjugate filaments of the invention is the synergistic flame retardancy of the filaments. Even though the filaments may contain only about 15 wt. % polyamide and no flame retardants, the conjugate filaments of the invention may have about a 75% increase in flame retardance relative to the flame retardance of pure polyolefin filaments. When desired, the polyolefin and polyamide conjugate filaments of the invention may also contain flame retardants. Flame retardants suitable for use with one or both of the polymers of the invention include brominated polystyrene, hexabromocyclododecane, octabromodiphenyl oxide, decabromodiphenoxyethane, decabromodiphenyl oxide, ethylene-bis(tetrabromophthalimide), ethylene-bis-(dibromonorborane dicarboximide), pentabromodiphenyl oxide, tetradecabromodiphenoxy benzene, aluminum oxide trihydrated, antimony oxide, sodium antimonate, zinc borate, di-acrylate ester of tetrabromobisphenol-A, and the like. A preferred flame retardant system will generally contain a halogenated organic compound and a flame retardant synergist such as antimony oxide. The total amount of flame retardant in each polymer may range from about 5 to about 15 wt. % of the total weight of conjugate filament.

While not desiring to be bound by theoretical considerations, it is believed that the properties of the carpet face yarn of the invention may be due, at least in part, to the formation of in-situ polyamide fibrils in a matrix of polyolefin. The in-situ fibril formation is due to the immiscibility of the polymers with one another, and the shear forces exerted on the molten mixture in the capillary openings. Fibrils of polyamide are thereby formed near the center of the capillary openings of the spinneret where the shear forces are the least. Typically the nylon fibrils thus formed have a diameter in the range of a fraction of a micron to a few microns and a length of several tens of microns whereas the overall cross-sectional length of each side of the trilobal or delta filaments containing the fibrils may range from about 1 to about 3 millimeters.

Since the amount of polyolefin in the mixture is much greater than the amount of polyamide, the polyolefin will form a matrix encapsulating the polyamide fibrils. These polyamide fibrils provide reinforcing to the polyolefin matrix similar to reinforcing provided by a welt having a semi-rigid inner core. Accordingly, the polyamide fibrils improve the resiliency of the yarn over yarn made only with polyolefin polymer.

Another factor which may contribute to the formation of fibrils in the center of the filament is the difference in the melt viscosity of the polyolefin and polyamide phases. At a shear rate of 2500 reciprocal seconds, polypropylene has a melt viscosity of 330 poises at 260° C. at the capillary wall. The melt viscosity for the same temperature and shear rate for nylon 6 having a relative viscosity of 2.4 is 700 poises and is 1160 poises for nylon 6 having a relative viscosity of 2.7. Accordingly, the ratio of polyamide melt viscosity to polyolefin melt viscosity is typically within the range of from about 2:1 to about 3:1 for forming the conjugate filaments of the invention. The lower polyolefin viscosity will cause the polyolefin to flow much faster through the capillary opening at the walls of the opening where the shear rate is highest while the polyamide flows through the sections of the capillary opening away from the walls.

EXAMPLE

A dry blend mixture of 14 wt. % nylon 6 having a relative viscosity of 2.4 (Type 403 from BASF Corporation) and 86 wt. % polypropylene pellets having a melt index of 12 (5A72 from Shell Chemical Company) were fed from a feed hopper directly into a 2½ inch hot melt extruder wherein a homogenous molten mixture was obtained. A beige polypropylene color concentrate was added to the molten mixture for color. The molten mixture was then pumped through a pack of screens to remove any particles greater than 20 microns. The screened mixture was pumped to a spinneret having a 40 trilobal capillary openings in order to form conjugate filaments. Each trilobal capillary had leg lengths of 0.0205 inches and leg widths of 0.008 inches. The extrusion rate was 0.625 pounds per hour per hole at 260° C. thereby producing a shear rate of 2450 reciprocal seconds. Carpet yarn was spun from the filaments thus formed in a two-step process. The spinning was done using nylon 6 extrusion conditions at 320 m/min. The filaments were spun at a denier of 2175 per 42 filaments (Delta) at 258° C. melt temperature to yield a spun yarn denier of 1825. The yarns were then drawn three times at 125° C. and hot air jet texturized at 130° C. The drawing was 2 ply to yield a textured, singles yarn having a denier of 1450 per 84 filaments. The relaxation ratio was 0.71:1 and the drawn denier was targeted for 1450 denier with 80 filaments. The physical properties of the two ply yarn are given in Table 1.

TABLE 1

| Description | Denier (gms) | Tenacity (gpd) | Elongation (%) | Crimp (%) |
|---|---|---|---|---|
| 100% SA72 | 1470 | 2.45 | 41 | 2.20 |
| 100% PA6 | 1451 | 3.20 | 50 | 3.21 |
| 10% PA6, 90% SA72 | 1463 | 2.49 | 49 | 2.92 |
| 15% PA6, 85% SA72 | 1490 | 2.61 | 45 | 3.15 |

The 1450 denier filaments were in turn also two-ply twisted and heat set. The twisting was 4.50×4.50 tpi and the heat set was done on a Superba Stuffer Box at a tunnel temperature of 135° C. To form a carpet from the yarn of the invention the filaments may be broadloom tufted in 34 ounce cut pile (54 stitches, 15/32 inch pile height). Carpet thus formed will have a Carpet Research Institute (CRI) floor rating above about 2 and generally from about 2 to about 3 whereas pure nylon carpet has a CRI floor rating of about 2.5 and pure polypropylene carpet has a CRI floor rating of about 1.8:

The carpet face yarn of the invention also exhibits a flame retardancy as determined by a Radiant Panel test in the range of from about 0.3 to about 0.4 watts/cm whereas pure nylon yarn has a flammability rating of about 0.5 to 0.6 watts/cm and pure polypropylene yarn has a flammability rating of about 0.2 to about 0.25 watts/cm. The apparent increase in flame retardancy appears to be a synergistic increase since the filaments contain at most about 15 wt. % nylon 6.

As compared to polypropylene without nylon reinforcement, the conjugate carpet yarn containing nylon fibrils has an increase in tensile strength, and fiber shrinkage. Accordingly, the 10% and 15% PA6 conjugate filaments are better than 100% polypropylene (SA72) in terms of flame retardance and resiliency and the 15% PA6 conjugate filament rate comparable to the 100% PA6 sample in terms of flame retardance and resiliency.

While it is preferred to utilize polyolefin and polyamide polymers without additives other than flame retardants and dyes or pigments, it will be recognized that the individual polymers which are combined to form the carpet face yarn of the invention may contain any one or more additives selected from antioxidants, fillers, antistatic agents, melt processing aids, uv and thermal stabilizers, plasticizers, and the like.

Stabilizers useful with the polymers used to form the conjugate filaments of the invention include calcium powders, calcium stearate, phenols and hindered phenols, zinc oxide, and the like.

Antioxidants may be selected from alkylated phenols and bisphenols, alkylidene-bisphenols, alkylidene-trisphenols, alkylidene polyphenols, thiophenols, dithio-bisphenols, dithio-trisphenols, thio-polyalkylated phenols, phenol condensation products, amines, dilauryl thiodipropionate, distearyl thiodipropionate, dimyristyl thiodipropionate, ditridecyl thiodipropionate, pentaerythritol tetrakis(β-lauryl thiopropionate), p-benzoquinone, 2,5-ditert-butylhydroquinone, and the like.

Having described the invention and its preferred embodiments, it will be recognized that the variations of the invention are within the spirit and scope of the appended claims.

What I claim is:

1. A carpet face yarn having a denier in the range of from about 1350 to about 1550 per 84 filaments consisting essentially of a trilobal cross-section polyolefin matrix containing a plurality of generally co-linear substantially smaller polyamide fibrils embedded within the polyolefin matrix wherein the polyamide fibrils comprise from about 5 to about 40 wt. % and the polyolefin comprises from about 60 to about 95 wt. % of the filaments.

2. The carpet face yarn of claim 1 wherein the polyolefin is polypropylene.

3. The carpet face yarn of claim 2 wherein the polyamide is nylon 6.

4. The carpet face yarn of claim 1 wherein the polyamide is nylon 6.

5. The carpet face yarn of claim 1 containing from about 10 to about 15 wt. % polyamide and from about 85 to about 90 wt. % polyolefin.

6. A trilobal carpet face yarn made by a method which comprises blending from about 5 to about 40 wt. % polyamide pellets with from about 60 to about 95 wt. % polyolefin pellets, feeding the blend to a hot melt extruder to melt the mixture and forcing the molten mixture at a shear rate within the range of from about 1000 to about 5000 reciprocal seconds through a spinneret containing a plurality of trilobal or delta capillary openings thereby forming trilobal cross-section filaments containing from about 5 to about 40 wt. % polyamide fibrils formed in-situ in from about 60 to about 95 wt. % polyolefin matrix, said yarn having a denier ranging from about 1350 to about 1550 per 84 filaments.

7. The carpet yarn of claim 6 wherein the polyolefin is propylene.

8. The carpet yarn of claim 7 wherein the polyamide is nylon 6.

9. The carpet yarn of claim 8 wherein the method therefor further comprises drawing the filaments three times and hot air texturizing the filaments, wherein both the drawing and texturizing are conducted at a temperature within the range of from about 120° to about 130° C.

10. The carpet yarn of claim 6 containing from about 10 to about 15 wt. % polyamide and from about 85 to about 90 wt. % polyolefin.

11. The carpet yarn of claim 6 wherein the method therefor further comprises drawing the filaments thus formed three times and hot air texturizing the filaments, wherein both the drawing and texturizing are conducted at a temperature within the range of from about 120° to about 130° C.

12. The carpet face yarn of claim 6 further comprising the step of dying the yarn with a dye which comprises a chemical dye selected from the group consisting of mono- and disulfonated acid dyes, anthaquinone, triphenylmethane, pyrazolone, azine, nitro and quinoline and a pigment dye selected from the group consisting of organic and inorganic pigment dyes.

* * * * *

UNITED STATES PATENT AND TRADEMARK OFFICE

CERTIFICATE OF CORRECTION

PATENT NO. : 5,597,650

DATED : January 28, 1997

INVENTOR(S) : William C. Mallonee

It is certified that error appears in the above-indentified patent and that said Letters Patent is hereby corrected as shown below:

Column 1, line 48, after "fibrils" change ",," to -- , --.

Column 5, line 37, change "1.8:" to -- 1.8 --.
and insert -- . --.

Column 5, line 39, change "watts/cm" to
-- watts/$cm^2$ --.

Column 5, line 40, change "watts/cm" to
-- watts/$cm^2$ --.

Column 5, line 42, change "watts/cm" to
-- watts/$cm^2$ --.

Signed and Sealed this

Tenth Day of June, 1997

Bruce Lehman

*Attest:*

BRUCE LEHMAN

*Attesting Officer*

*Commissioner of Patents and Trademarks*